US010221040B2

(12) United States Patent
Madar

(10) Patent No.: US 10,221,040 B2
(45) Date of Patent: Mar. 5, 2019

(54) ELEVATOR BRAKE MONITORING AND CONTROL

(71) Applicant: Yoram Madar, Rishon Lezion (IL)

(72) Inventor: Yoram Madar, Rishon Lezion (IL)

( * ) Notice: Subject to any disclaimer, the term of this patent is extended or adjusted under 35 U.S.C. 154(b) by 0 days.

(21) Appl. No.: 15/744,807

(22) PCT Filed: Aug. 1, 2017

(86) PCT No.: PCT/IL2017/050852
§ 371 (c)(1),
(2) Date: Jan. 14, 2018

(87) PCT Pub. No.: WO2018/033902
PCT Pub. Date: Feb. 22, 2018

(65) Prior Publication Data

US 2019/0039859 A1 Feb. 7, 2019

(30) Foreign Application Priority Data

Aug. 18, 2016 (IL) ..... 247342

(51) Int. Cl.
*B66B 1/34* (2006.01)
*B66B 5/00* (2006.01)

(52) U.S. Cl.
CPC ..... *B66B 5/0031* (2013.01)

(58) Field of Classification Search
CPC ..... B66B 5/0031
USPC ..... 187/247, 287, 288, 313, 316, 391, 393
See application file for complete search history.

(56) References Cited

U.S. PATENT DOCUMENTS 3,961,688 A * 6/1976 Maynard ..... B66B 5/02 187/289
7,353,916 B2 * 4/2008 Angst ..... B66B 5/0031 187/393
7,575,102 B2 * 8/2009 Matsuoka ..... B66B 5/0093 187/391
7,669,697 B2 * 3/2010 Ueda ..... B66B 5/02 187/292
7,775,329 B2 * 8/2010 Eckenstein ..... B66B 1/32 187/277
7,896,138 B2 * 3/2011 Syrman ..... B66B 5/0031 187/289

(Continued)

FOREIGN PATENT DOCUMENTS

EP 1792864 6/2007

*Primary Examiner* — Anthony J Salata
(74) *Attorney, Agent, or Firm* — Law Office of Steven W. Weinrieb

(57) ABSTRACT

An electric circuit for monitoring and controlling of at least one elevator emergency safety for braking elevator car from moving is provided. The electric circuit installed in an elevator having a control panel, a lifting machine having at least one motor brake and emergency safety braking and floor signal (FS) device. The electric circuit includes a switching device RFS energize or de-energized depending on electric signal of said FS device. The electric circuit further includes a switching device RGX having contacts RGX-1 and RGX-2, a switching device RG having contacts RG-1 and RG-2 and a switching device RBRK for indicating the state of the motor braking(s). The electric circuit further includes contact RBRK-1 of the switching device RBRK and contacts RFS-1 and RFS-2 of the RFS switching device.

10 Claims, 3 Drawing Sheets

(56) References Cited

U.S. PATENT DOCUMENTS

| | | | | |
|---|---|---|---|---|
| 8,235,180 | B2 * | 8/2012 | Kattainen | B66B 1/32<br>187/288 |
| 8,272,482 | B2 * | 9/2012 | Takahashi | B66B 1/32<br>187/393 |
| 8,365,873 | B2 * | 2/2013 | Viita-Aho | B66B 5/0031<br>187/314 |
| 8,413,765 | B2 * | 4/2013 | Stratmann | B66B 5/0031<br>187/247 |
| 8,430,212 | B2 * | 4/2013 | Ueda | B66B 5/0031<br>187/247 |
| 8,584,812 | B2 * | 11/2013 | Dorsch | B66B 5/0031<br>187/287 |
| 8,602,170 | B2 * | 12/2013 | Fischer | B66B 11/043<br>187/288 |
| 8,752,677 | B2 * | 6/2014 | Harkonen | B66B 1/34<br>187/391 |
| 8,820,484 | B2 * | 9/2014 | Rui | B66B 1/32<br>187/288 |
| 9,061,863 | B2 * | 6/2015 | Birrer | B66B 13/22 |
| 9,367,416 | B2 * | 6/2016 | Hovi | B66B 5/0031 |
| 9,434,575 | B2 * | 9/2016 | Kattainen | H02P 3/02 |
| 9,663,323 | B2 * | 5/2017 | Stolt | B66B 1/30 |
| 10,035,680 | B2 * | 7/2018 | Richter | B66B 5/0031 |
| 10,065,832 | B2 * | 9/2018 | Kubota | B66B 1/32 |
| 10,106,373 | B2 * | 10/2018 | Nakari | B66B 1/36 |
| 2017/0001833 | A1 * | 1/2017 | Lustenberger | B66B 13/22 |
| 2018/0002138 | A1 * | 1/2018 | Kattainen | B66B 5/02 |

* cited by examiner

ELEVATOR BRAKE MONITORING AND CONTROL

FIELD OF THE INVENTION

The present invention relates to elevator safety, in particular to elevator brakes monitoring and control.

BACKGROUND OF THE INVENTION

Elevators having elevator car are type of transportation where the elevator car travels vertically or approximately vertically to a landing within a hoistway. The elevator car is typically travelling upon car guide rails and serves stations, landing or floors along way of the car vertical travelling.

Automatic elevators are referred to as elevator cars that respond automatically by momentary pressing a button that calls the elevator car to a designated floor and without stopping between floors.

Non automatic elevators are referred to as elevators that the button that calls the elevator car to the designated stop must be pressed until the elevator car reaches to the designated floor.

A conventional elevator typically includes, elevator control panel, elevator car which is used to lift and lowering a load such as but not limited to people. The elevator car is designed to lift predetermine maximum load. A counterweight is used for balancing the elevator car, usually the counterweight weights 50% from the maximum allowed weight in the elevator car. The elevator further includes cables or ropes that are connected between the counterweight and the elevator car. The elevator further includes a lifting machine that is used as a driving force for lifting and lowering the elevator car load. The elevator car further includes a safety braking or catching mechanism such as but not limited to guide rail braking safety system which is a mechanical catching device that is used to break or lock the elevator car on the elevator guide rails, for example in case where there is a free falling of the elevator car. The mechanical catching device can be operated mechanically or operated by an electrical command.

The lifting mechanism typically includes an electric motor which is used for driving directly or with transmission arrangement of friction wheels. Upon the friction wheels hanged the cables that are connected between the elevator car and the counterweight. The friction between the cables and the friction wheels allows travel movement of the elevator car and the counterweight which are driving by the lifting machine. The elevator further includes a flywheel or any other means that is typically connected directly or indirectly to the electric motor shaft which helps to stop/brake the lifting machine. On the lifting machine typically installed one or more braking(s) devices that are used to prevent from the lifting machine travelling of the elevator car when the electric motor of the lifting machine doesn't receive electrical current. The braking(s) device(s) and the electrical motor receive electric power from the same source. When the braking(s) device(s) receives electric power they are held open electrically allowing the motor rotation. A power failure will cause the brake to engage with the flywheel and prevent the elevator from moving. The braking(s) device(s) typically include one or more shoes or pad drop. The braking(s) device(s) further includes one or more adjustable braking springs and one or more electromagnets. When the electric motor receives electric power, this brake is electrically lifted or "picked" against the adjustable tensioned or compressed springs. When the electric motor doesn't receives electric power the electrical power is also removed from the braking(s) device(s), these springs ensure the immediately drops back against the flyingwheel, bringing the car to a safe stop. When the braking(s) device(s) are not energized they will securely hold in place the elevator and the counterweight. When the elevator car travelling movement is desired the electromagnet is energized thereby a force is applied on the shoes or pads causing them to depart slightly from the flywheel and thus the flywheel can rotate freely. Some of the braking devices include adjusting means such as an adjusting screw that is used for adjusting the distance between the brake shoes and the flywheel and also for adjusting the pressure that brake spring(s) apply on the flywheel when the electromagnet is not energized.

The braking force is determined according to the weight of the elevator because the counterweight is heavier than the weight of the elevator car and the weight is roughly equal to the weight of the elevator car with approximately half of the load permitted to carry in the elevator car due to an imbalance between the elevator car weight and the counterweight. The brake is considered a safety device that without the braking device the elevator car will move freely due to the imbalance between the elevator car weight and the counterweight.

During normal working hours of the elevator there is a friction reduction, the brake shoes are worn away and the braking force of the brakes is reduced. This friction reduction of the brake shoes is reduced even more as a result of an electrical fault. In this case the brake shoes are not open when the motor receives voltage and manages to rotate the flywheel even when the brake shoes are in a closed position. Another known fault is when the braking shoes remains open even though the electromagnet is not receiving voltage. In each of these cases described above, the elevator car will move freely and without control, even when the elevator car doors and hoistway doors are open.

In such cases, the elevator control panel does not receives electrical signals that notifies that the elevator car is moving in the hoistway and therefore will not do anything to prevent this action. What is needed in this scenario is activation of the emergency brake that locks for example the elevator car on the elevator guide rails and prevents elevator car movement.

U.S. Pat. No. 5,509,505 describes an arrangement for detecting elevator car position relative to a floor landing includes an optical potentiometer associated with both the elevator car and the interior of an elevator hoistway. One portion of the potentiometer is attached to the elevator car, while the other portion of the potentiometer is fixed within the hoistway. Car position is ascertained by illuminating portions of a fluorescent fiber optical cable and then reading electrical signals outputted by photodetectors at either end of the cable. The difference between the electrical signals corresponds to the distance of the elevator car from the landing.

U.S. Pat. No. 3,685,618 describes a floor selector comprising a tracing means moved with the elevator movement, but on a reduced scale, and a preceding means driven ahead of the tracing means simultaneously with start of the elevator cage at a higher speed than the tracing means; wherein molded oscillators are installed on the tracing means, molded receivers are provided on the preceding means, and the outputs of the receiver are combined logically whereby various signals for controlling the elevator operation are obtained.

US 20130025973A1 describe An elevator control device includes a control device body controlling operation of one or more elevators operated between plural floors of a building, and carries out emergency evacuation operation for evacuating people by using an elevator when the building suffers from fire, earthquake, or the like. The elevator control device includes a damage detector that detects damage due to disaster at each floor and outputs the detected damage as damage information of each floor; and a person detector that detects the number and positions of persons present at each floor and outputs these data as person number and position information, and in the emergency evacuation operation, the elevator control device body develops an elevator evacuation operation plan based on the position of the elevator car, the damage information, and the person number and position information, and controls the operation of elevator based on the developed evacuation operation plan.

U.S. Pat. No. 4,245,721 describe a U-shaped channel is mounted on the elevator car. A solid vane is mounted on the shaft wall near each floor. As the car approaches each floor the vane passes between the walls of the U-shaped column. A plurality of photo transmitter-receivers are mounted on the channel. The receivers on one wall and the transmitters on the opposite wall. As the vane passes between the walls, it obscures or occludes the light from the transmitters and the receivers are successively turned on and off in an arrangement indicative of the distance to the floor level.

U.S. Pat. No. 8,584,812 describes a brake monitor for monitoring a brake system of an elevator system that includes a drive and a drive controller checks for a travel signal generated by the elevator system. If a brake-release signal is not received within a time-window after the occurrence of the travel signal, the brake monitor activates a relay circuit for interrupting a safety circuit of the elevator system or for interrupting a control voltage of the drive controller so that the elevator system can be stopped.

CA2731667C describe brake monitor for monitoring a brake system of an elevator system that includes a drive and a drive controller in addition to the brake system. The brake monitor includes a first brake signal input for electrically connecting the brake monitor to a first brake contact of the brake system. The brake monitor further comprises a driving signal input for connecting the brake monitor to a first electrical driving signal line of the drive controller. Also provided are a power supply, a microprocessor and a relay circuit. The relay circuit is configured such that it can be activated for interrupting a safety circuit of the elevator system or for interrupting a control voltage of the drive controller so that the elevator system can be stopped.

US2011011682 describes an elevator drive has a brake device with compression springs to actuate brake levers, and brake linings on a brake drum creating a braking force. A sensor is provided to detect the movement of a brake magnet armature tappet. A bracket is attached to the brake magnet tappet on one end and a distance piece carrying the sensor housing is arranged on the other end. A restoring lug is attached to the existing mechanical indicator. A monitor evaluates the sensor signal and turns off the elevator drive in the event of dangerous operational states via a safety circuit. The system allows the state of the brake device to be monitored. The more the brake linings wear off due to abrasion, the smaller the distance between the armature and the brake magnet housing. If the armature is in contact with the brake magnet housing, the braking ability of the brake linings is completely void.

The problem with this solutions is that normally with existing elevators there are many types of elevator motors and brakes, thus there is a need to match for each motor and brake the right sensitive electric switches and sensors that will fit and there is a need to customize the way the switches are connected or grabbed with the motor/brake.

In addition every type of elevator typically have different control panel and when installing additional switches for monitoring the brakes there is a need to do changes in the elevator control panel. Changes in the elevator control panel require authority's approval. In addition the installation time of the sensitive switches is long and expensive.

Furthermore, the efficiency of such a switches system is not very high, first, it requires very sensitive switches with a small crawl space of about 1 mm which are installed in an unclean environment and therefore their reliability over the years is reduced. An additional disadvantage of the methods known in the art is that it checks if the brake does not open or the does not close which is based on the state of the switches. In this method the elevator system cannot recognize for example the state of the brake shoes and the grade erosion of the brake shoes that may cause the elevator car moving freely when the electric motor doesn't receive power. In this case, the switches system shows that brake shoes are in closed state while elevator car moving freely because there isn't friction or small friction between the flywheel and the brake shoes.

The solutions which are known in the art are, monitoring the status of the brakes by adding one or more switches which are sensitive on the brake shoes that change their state according to a gap between the flywheel and the brake shoes. If for some reason the brake is not open when the electric motor receives electric power or the brake is not in closed position when the electric motor doesn't receive electric power, the control panel of the elevator will stop the power to the electric motor.

One of the objects of the present invention is to provide elevator brake monitoring system and method that monitor also the erosion of the brake shoes.

Yet another object of the present invention is to provide elevator brake monitoring system and method that monitor the erosion of the brake shoes which is not dependent with the switching system that was described above.

Yet another object of the present invention is to provide elevator brake monitoring system and method which is based on monitoring of the state of the electric power to the brake(s) and the elevator car position. By these monitoring, a decision is made to decide if whether to activate the elevator emergency brake or not.

Another object of the present invention is to provide elevator brake monitoring/controlling system and method which is simple to install and use and can fit for all types of elevators that moves with cables/ropes and lifting machine is equipped with brake(s).

Another object of the present invention is to ensure that the emergency brake will not be activated whenever the car stops between floors intentionally or unintentionally during normal operation.

SUMMARY OF THE INVENTION

The present invention relates to elevator safety, in particular to elevator brakes monitoring and control.

In accordance with one aspect of the present invention there is provided an electric circuit for monitoring and controlling of at least one elevator emergency safety for braking elevator car from moving. The electric circuit installed in an elevator having a control panel, a lifting machine having at least one motor brake and emergency safety braking and floor signal (FS) device. The electric circuit includes a switching device RFS energize or de-energized depending on electric signal of said FS device. The electric circuit further includes a switching device RGX having contacts RGX-1 and RGX-2, a switching device RG having contacts RG-1 and RG-2 and a switching device RBRK for indicating the state of the motor braking(s). The electric circuit further includes contact RBRIS-1 of the switching device RBRK and contacts RFS-1 and RFS-2 of the RFS switching device.

when RBRK switching device indicating that the motor braking(s) are in braking position, contact RBRK-1 transfer an electric power to the contact RFS-1 of the switching device RFS. When the elevator car reaches to a floor or nearby of a floor, the switching device RFS is indicating that the elevator car reaches to a floor or nearby of a floor and the contact RFS-1 transfer power to the switching device RGX which is energized. The switching device RGX continues to be energized due to the contact RGX-1 even when elevator leaves a floor. The switching device RFS is de-energized and when elevator car leaves floor, contact RFS-1 returns to de-activated state. The switching device RGX remains energized as long as switching device RBRK is not energized. When the elevator car leaves the floor when switching device RGX is energized and also switching device RFS is not energized, that means that the elevator car leaved the floor when switching device RBRK is not energized, in this case one or more of the elevator emergency safety is activated. Electric power is transferred through the contacts RGX-2 and RFS-2, which energize the switching device RG, the switching device RG hold itself energized by the RG-1 contact. When the switching device RG is in energized state the contact RG-2, transfer power to the switching device of the elevator emergency braking for activating the elevator emergency braking and locking the elevator car from travelling.

BRIEF DESCRIPTION OF THE DRAWINGS

The invention may be understood upon reading of the following detailed description of non-limiting exemplary embodiments thereof, with reference to the following drawings, in which.

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

The present invention relates to elevators safeties in particular a method and a system to prevent accidents that are caused as a result of brakes malfunction of the elevator lifting machine. In accordance with the present invention malfunction of the elevator lifting machine can be identified by monitoring the behavior of the elevator car in contrast to prior art publications that check/monitor the behavior of the lifting machine brakes using sensors and switches.

Figure 1:
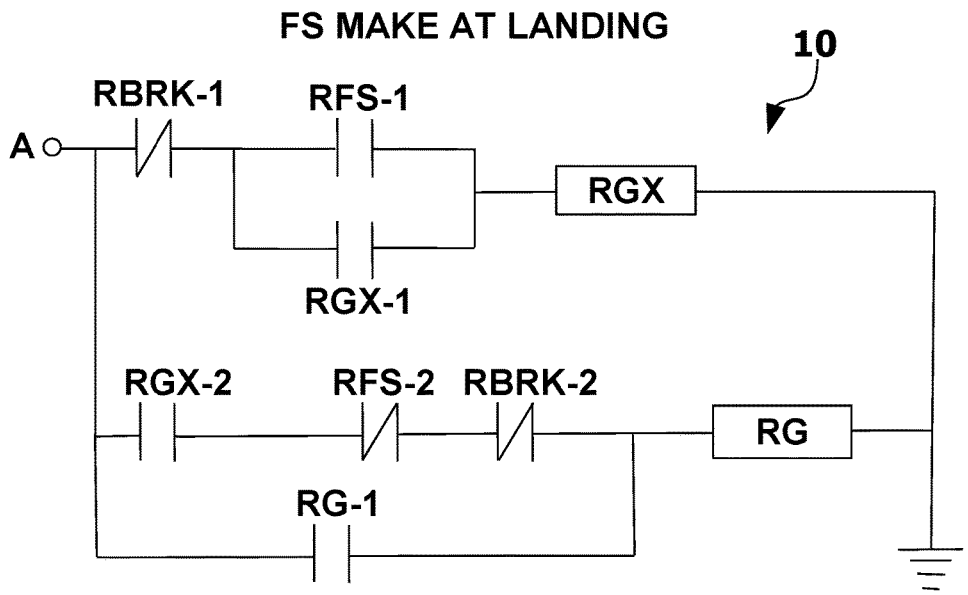
FIG. 1 is an electric circuit in accordance with an embodiment of the present invention for monitoring elevator lifting machine brakes and activating of the elevator emergency brakes in case of lifting machine malfunction and where FS make at landing.

Referring first to FIG. 1 there is shown an electric circuit 10 in accordance with one of the embodiments of the present invention. Circuit 10 receives electric power from a point A that feed two switching devices referred to as RG and RGX. The switching devices RGX and RG can be automatically energized or de-energized and may be any suitable switching devices known in the art for operating contacts RGX-1, RGX-2, RG-1 and RG-2 respectively. For example, the switching devices can be relays or transistor switching circuits. In some embodiments of the present invention a micro controller may replace the switching devices for operating one or more of the contacts in the electric circuit 10 of the invention. The electric circuit 10 of the invention causes activation of one or more of the elevator emergencies safeties such as but not limited to activation of emergency safety gear and emergency elevator rope Gripper™. When switching device RG is electrically activated for example energized, contact RG-2 of switching device RG shown in FIGS. 5A and 5B will activate one or more of the elevator safeties such as, but not limited to the elevator safety gear thereby, causing the braking of elevator car on the elevator guide rails.

In conventional elevators there is a FS (floor signal) device which is used for indicating elevator floor landing. The FS device sends an electric signal to the elevator control panel every time the elevator car reaches to a floor or stop at the floor. The FS device may also send a signal when the elevator car passes a floor when the elevator travels without stopping at the floor. In any case, the elevator control panel, by receiving floor signal, "knows" in which floor the elevator car is. The elevator FS signal of FS device may refers to an electric signal that the elevator control panel receives from FS device that indicate the location of the elevator car in the elevator shaft. FS make at landing refers to a close contact of RFS-1 (normally open contact, see for example in FIG. 1) when elevator car reaches a floor and FS brake landing refers to open contact RFS-1 (normally close contact, see for example in FIG. 2) when elevator car reaches a floor.

Figure 4:
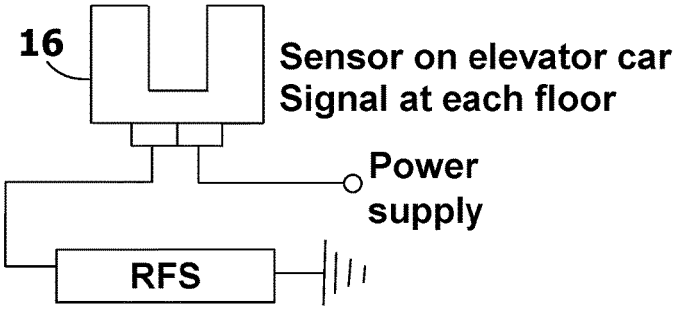
FIG. 4 is a schematic description of FS device electrically connected to RFS switching device.

Referring also to FIG. 4 in accordance with the present invention an RFS switching device is electrically connected to FS device and is energized or de-energized according to the FS signal state. RFS switching device is operating normally open contact RFS-1 and normally closed contact RFS-2 in case of the electric circuits shown in FIG. 1 and FIG. 6. RFS switching device is operating normally close contact RFS-1 and normally open contact RFS-2 in case of the electric circuits shown in FIG. 2 and FIG. 7.

Figure 3:
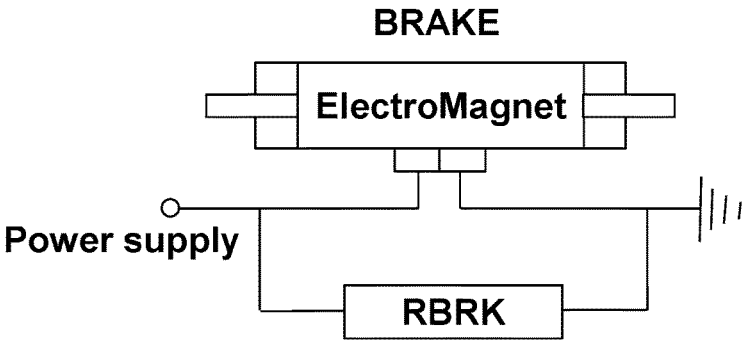
FIG. 3 is a schematic description of exemplary elevator braking connected to switching device RBRK.

Referring also to FIG. 3 a switching device RBRK is connected parallel for example to a conventional coil electromagnet of a conventional elevator motor brake. As described above, when the elevator electric motor received electric power also the motor brake receives electric power, the elevator motor brake is in open position and the RBRK is energized. Switching device RBRK is operating two normally closed contacts RBRK-1 and RBRK-2. In some embodiment of the present invention RBRK-2 can be omitted. RBRK-2 contact is more as a double safety if for some reason contact RBRK-1 will malfunction.

Referring also to FIG. 4 switching device RFS is electrically connected to FS device 16 which could be for example and without limitation a micro switch or sensor or any other means that identifies when elevator car reaches or passes a floor. When the elevator car reaches to an elevator floor or passes elevator floor in a normal elevator traveling the RFS switching device behaves in accordance with switch/sensor FS signal state. Meaning for example, that when FS device 16 identifies that the elevator is reaches a certain floor then switching device RFS change its state (for example from de-energized to energized). When the elevator car leaves the floor FS device 16 changes its state and also switching device RFS change its state accordingly. Switching device RFS is operating contact RFS-1 which is a normally open contact and RFS-2 which is a normally closed contact in case of the electric circuits 10, 20 shown in FIG. 1 and FIG. 6 respectively. Switching device RFS is operating contact RFS-1 which is a normally closed contact and RFS-2 which is a normally open contact in case of the electric circuits 12, 24 shown in FIG. 2 and FIG. 7 respectively. Electric circuits 10, 12, 20 and 24 further include switching device RGX having two normally open contacts RGX-1 and RGX-2.

Referring to FIG. 1, FIG. 3, FIG. 4 and FIG. 5A, in operation, for example when RBRK switching device is not energized, normally closed contact RBRK-1 transfers the electric power or voltage to normally open contact RFS-1 of switching device RFS. When the elevator car reaches to a floor or nearby of a floor, switching device RFS receives signal from device FS and RFS is energized and thus contact RFS-1 transfers power/voltage to switching device RGX which is energized. Switching device RGX continues to be energized due to its normally open contact RGX-1 even when elevator leaves a floor, RFS is de-energized and contact RFS-1 returns to its normally open state. The switching device RGX remains energized as long as switching device RBRK is not energized.

Figures 5A, 5B:
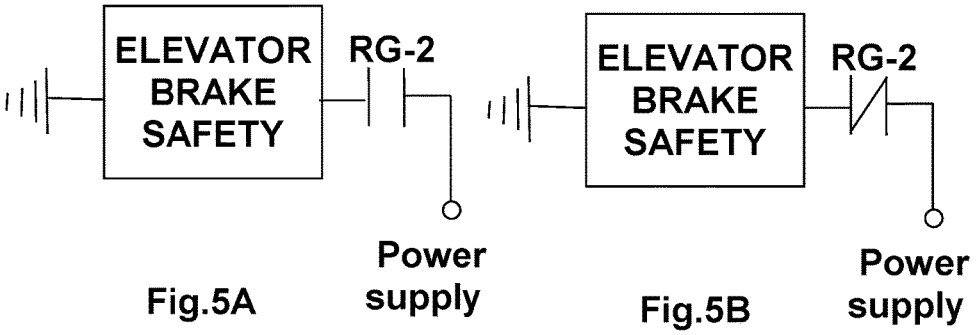
FIG. 5A is a schematic description of a normally open contact RG-2 electrically connected to elevator brake safety.
FIG. 5B is a schematic description of a normally close contact RG-2 electrically connected to elevator brake safety.

If for some undesired reason the elevator car leaves the floor when switching device RGX is energized and also switching device RFS is not energized, that means that the elevator car leaved the floor when switching device RBRK is not energized, in this case the elevator emergency safeties such the safety gear must be activated. The elevator emergency safety gear is activated as follows; electric power is transferred through contacts RGX-2, RFS-2 and RBRK-2, which energize switching device RG, switching device hold itself energized by its normally open RG-1 contact. When switching device RG is in energized state normally closed contact RG-2, shown in FIG. 5B, transfers electric power to the elevator emergency brake and causes activation for example of the emergency safety gear and locking the elevator car from travelling. It should be noted that switching device RG can activate elevator brake safety also when operating a normally open contact RG-2 for example as shown in FIG. 5A which is depending on the way the elevator brake safety is activated. Furthermore, there could be an unwanted scenario that during normal operation the car stops between floors for example when the car heats a door lock that causes momentary stops between floors. In such a case, there is no need or desire to activate the emergency brake and the proposed solution of the present invention will prevent such action. If the car passes an FS signal during its normal run and then heats a door lock that cause elevator car stops the RGX remain de-energized there for when the car stops between floors and RBRK contacts are de-energized thus RG switching device will not be energized.

Figure 2:
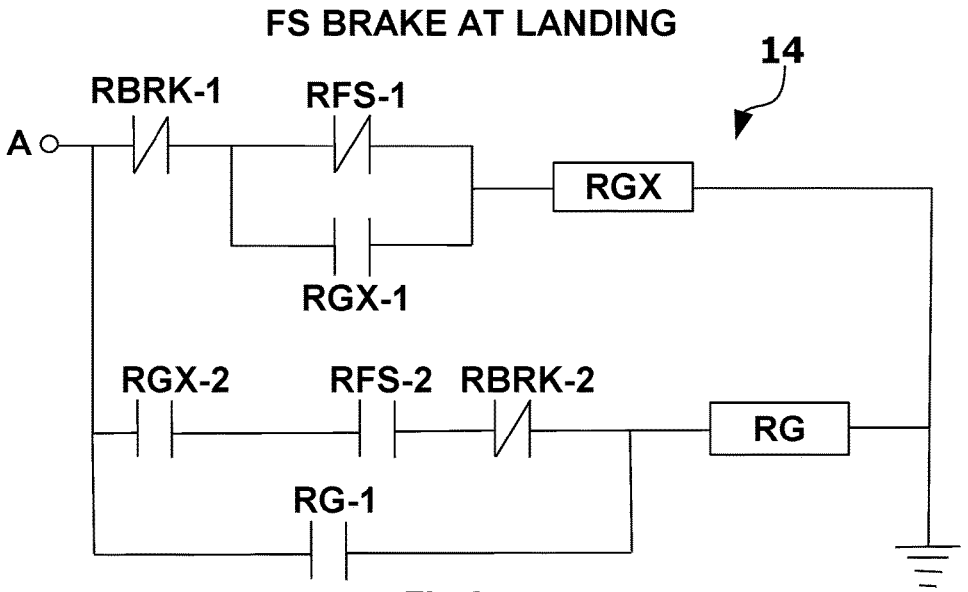
FIG. 2 is an electric circuit as in FIG. 1 where FS brake at landing.
Figure 6:
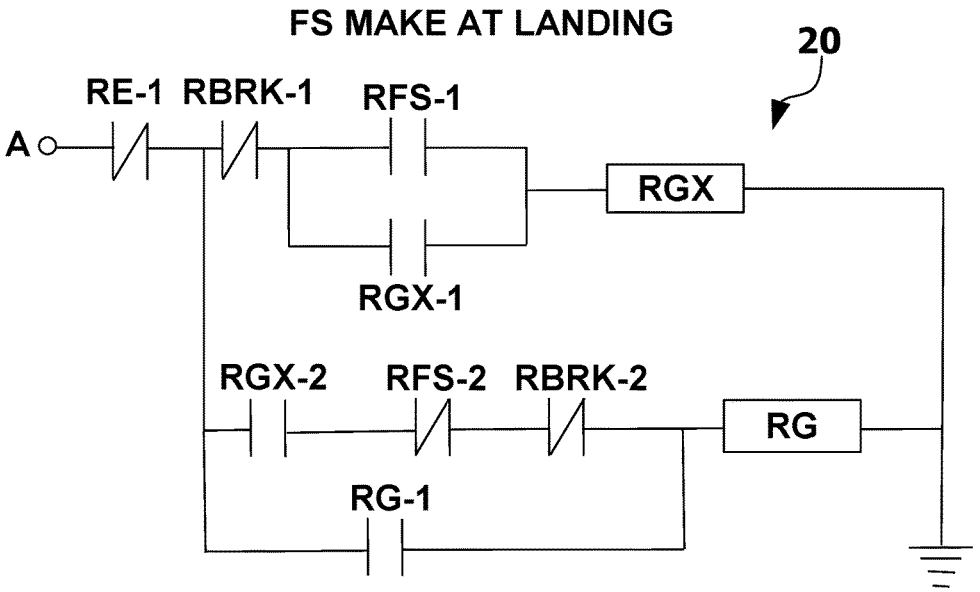
FIG. 6 is an electric circuit in accordance with another embodiment of the present invention where a normally closed contact RE-1 is serially and electrically connected to the circuit shown in FIG. 1.
Figure 7:
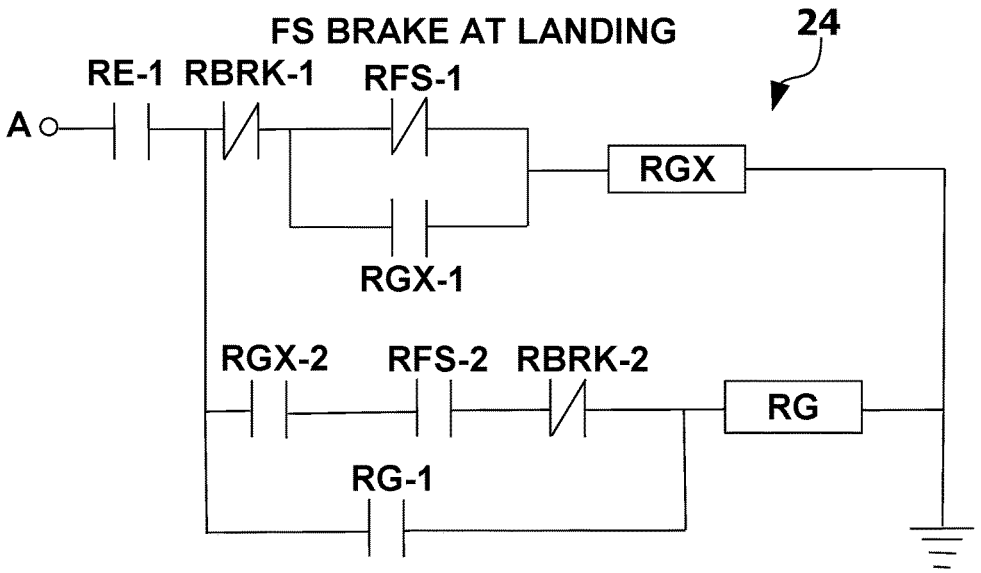
FIG. 7 is an electric circuit in accordance with another embodiment of the present invention where a normally open contact RE-1 is serially and electrically connected to the circuit shown in FIG. 2.

Referring also to FIGS. 6 and 7 in series to the electric circuits that were shown in FIGS. 1 and 2, contact RE-1 of switching device RE is electrically connected to the circuits. Conventional elevators further include inspection key or switch which is used to activate elevator in inspection service mode. Switching device RE is electrically feed from elevator inspection switch of the elevator. Every time that the inspection switch is change its own state to elevator inspection service mode switching device RE, for example, is energized. When inspection switch is not activated the switching device RE is not energized and the elevator is in normal command mode of operation. Referring also to FIG. 7, In some embodiment of the present invention switching device RE can work oppositely, meaning that when RE is not energized the elevator goes to normal mode of operation and when RE is energized the elevator goes to service mode of operation.

The electric circuit 20 is feed from electric power source in point A. The electric power that comes from point A goes through normally closed contact RE-1 of electric device RE which ensures that the electric circuit of the invention will have impact on elevator emergency safety gear only when the elevator operates in normal or automatic mode. If the elevator is in inspection service mode the electric circuit of the invention will not have impact on the elevator emergency safety gear.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. An electric circuit for monitoring and controlling of at least one elevator emergency safety for braking elevator car from moving, said electric circuit installed in an elevator having a control panel, a lifting machine having at least one motor brake and emergency safety braking and floor signal (FS) device, said electric circuit comprising:

a switching device RFS energize or de-energized depending on electric signal of said FS device;

a switching device RGX having contacts RGX-1 and RGX-2;

a switching device RG having contacts RG-1 and RG-2;

a switching device RBRK for indicating the state of said motor brake(s);

contact RBRK-1 of said switching device RBRK;

contacts RFS-1 and RFS-2 of said RFS switching device;

wherein, when RBRK switching device indicating that said motor brakes are in braking position, contact RBRK-1 transfer an electric power to said contact RFS-1 of said switching device RFS; when said elevator car reaches to a floor or nearby of a floor, said switching device RFS indicating that said elevator car reaches to a floor or nearby of a floor and said contact RFS-1 transfer power to said switching device RGX which is energized; said switching device RGX continues to be energized due to said contact RGX-1 even when elevator leaves a floor, said switching device RFS is de-energized and when elevator car leaves floor, contact RFS-1 returns to de-activated state; said switching device RGX remains energized as long as switching device RBRK is not energized; when said elevator car leaves said floor when switching device RGX is energized and also switching device RFS is not energized, that means that said elevator car leaved said floor when switching device RBRK is not energized, in this case the at least one elevator emergency safety is activated; electric power is transferred through said contacts RGX-2 and RFS-2, which energize said switching device RG, said switching device RG hold itself energized by said RG-1 contact; when said switching device RG is in energized state said contact RG-2, transfer power to said switching device of said elevator emergency braking for activating said elevator emergency braking and locking said elevator car from travelling.

2. An electric circuit for monitoring and controlling of at least one elevator emergency safety as in claim 1, further comprising switching device RE operating contact RE-1, said switching device RE when active, indicating said elevator is in service command mode and operating said contact RE-1 to transfer electric power to said electric circuit thereby, cancel said electric circuit when said elevator works in service mode of operation.

3. An electric circuit for monitoring and controlling of at least one elevator emergency safety as in claim 1, wherein at least one of said switching devices is an electromagnet operating said contacts.

4. An electric circuit for monitoring and controlling of at least one elevator emergency safety as in claim 1, wherein at least one of said switching devices is a transistor circuitry operating said contacts.

5. An electric circuit for monitoring and controlling of at least one elevator emergency safety as in claim 1, wherein at least one of said switching devices is a microcontroller circuitry operating said contacts.

6. An electric circuit for monitoring and controlling of at least one elevator emergency safety as in claim 1, wherein said electric circuit having said contacts are selectively normally closed or normally open contacts depending on how FS device, motor brake and emergency safety brake are operating and activated.

7. An electric circuit for monitoring and controlling of at least one elevator emergency safety as in claim 1, wherein said RBRK switching device further include contact RBRK-2 which is used as a double safety to ensure the activation of said emergency safety braking in an emergency.

8. A method for monitoring and controlling of at least one elevator emergency safety for braking elevator car from moving, installed in an elevator having a control panel, emergency safety braking and floor signal (FS) device, an electric circuit having a switching device RGX operating at least two contacts, a switching device RG operating at least two contact, a switching device RBRK operating at least one contact, a switching device RFS and a lifting machine having at least one motor braking, said method comprising the steps of:

receiving to said control panel, electric signal about the state of the electric motor brakes whether said electric motor brakes receives electric power or not;

receiving to said control panel electric signal (FS) about whether said elevator car reached floor, nearby floor, passed floor or not;

if said electric signal of a floor signal (FS) signals that elevator car reached floor, nearby floor or passed a floor and said electric signal about the state of the electric motor brakes that comes from contact of RBRK switching device signals that the motor brakes are in braking state, then RGX switching device is activate/energized and sends with said RGX's contacts a signal indicating that said motor braking didn't receive power and said elevator car reached floor, nearby floor or passed a floor; if RGX is activated/energized when not receiving signal FS and said electric signal about the state of the electric motor braking, signals that the motor brakes didn't receive power then activating switching device RG, if said switching device RG is activated then activating said elevator emergency safety.

9. A method for monitoring and controlling of at least one elevator emergency safety as in claim 8, wherein said method further comprising the step of indicating if said elevator is in inspection service command mode or regular operation mode.

10. A method for monitoring and controlling of at least one elevator emergency safety as in claim 9 wherein a switching device RE operating a contact RE-1, said switching device RE when active, indicating said elevator is in service command mode and operating said contact RE-1 to transfer electric power to said electric circuit thereby, cancel said electric circuit when said elevator works in service mode of operation.

* * * * *